US005346073A

United States Patent [19]

Broersma et al.

[11] Patent Number: 5,346,073

[45] Date of Patent: Sep. 13, 1994

[54] PORTABLE GUITAR STAND

[76] Inventors: Dennis W. Broersma; Broersma: Donna A., both of 1540 Calle Fidelidad, Thousand Oaks, Calif. 91360

[21] Appl. No.: 965,871

[22] Filed: Oct. 23, 1992

[51] Int. Cl.[5] ..... A47F 7/00

[52] U.S. Cl. ..... 211/13; 248/309.1

[58] Field of Search ..... 211/13; 248/205.2, 345.1, 248/309.1, 300, 302; 84/327

[56] References Cited

U.S. PATENT DOCUMENTS

| | | | |
|---|---|---|---|
| 3,664,224 | 5/1972 | Campagna, Jr. | 84/1.01 |
| 3,765,633 | 10/1973 | Caudill | 248/229 |
| 3,915,528 | 10/1975 | Glickman | 248/345.1 X |
| 4,345,732 | 8/1982 | Gallegos | 248/441 |
| 4,546,688 | 10/1985 | Cuccio | 84/327 |
| 4,779,831 | 10/1988 | Anderson | 248/205.2 X |
| 4,991,809 | 2/1991 | Harkey | 248/231.4 |
| 5,000,418 | 3/1991 | Vogt | 248/689 |
| 5,007,609 | 4/1991 | Bredovskis | 248/309.1 X |
| 5,031,868 | 7/1991 | Thomas, II | 248/283 |

FOREIGN PATENT DOCUMENTS 2753518 7/1979 Fed. Rep. of Germany .

*Primary Examiner*—Robert W. Gibson, Jr.
*Attorney, Agent, or Firm*—Spensley Horn Jubas & Lubitz

[57] ABSTRACT

A portable guitar stand, which can be used with guitars, and can rest atop an amplifier or table and support guitars or similar objects without clamping or permanently attaching the stand to the fixtures. The object is cradled by a recess in the stand which supports the object when the stand is placed on an amplifier or table. The bottom of the object normally rests on a lower surface. Due to the low profile and simple construction, the stand is very portable and can easily be stowed away in a guitar case.

21 Claims, 10 Drawing Sheets

PORTABLE GUITAR STAND

FIELD OF THE INVENTION

This invention relates to a portable guitar stand, which can be used with guitars or other similarly constructed objects.

BACKGROUND OF THE INVENTION

Guitar stands are used to hold guitars in a variety of situations, such as in store displays, during performances or just to store a guitar outside its cumbersome case while not in use.

Some conventional, free standing guitar stands include a free standing frame having a lower surface for supporting the base of the instrument and an upper neck support for supporting the neck of the instrument. The stand may be placed anywhere in a room, however, this design requires and takes up a considerable amount of floor space. Because these designs take up floor space they may have to be placed in awkward areas and can present a safety hazard by increasing the risk of tripping.

Various conventional portable guitar stands are comprised of several parts. These portable guitar stand must be unpacked and set up for use, then folded up and packed again after use. This tends to make the stands inconvenient to use, because time must be spent setting them up and then taking them down. Further, these designs tend to be less stable, since they must be light weight to be easily moved.

Another alternative to the portable guitar stand comprises a neck cradle which is permanently attached by screws to an amplifier, such as that described in U.S. Pat. No. 4,345,732 to Gallegos. This requires less usable floor space, since the guitar would rest against the floor directly adjacent the amplifier. However, once this guitar stand is mounted to an amplifier, the guitar stand is not easily movable from place to place. Also, since screws are used to mount the stand to the amplifier, installation tends to cause permanent damage to the amplifier to which it is attached. Guitar players may be reluctant to permanently disfigure their expensive amplifier. Furthermore, this type of device typically has multiple parts which makes it difficult to set up and use.

A variation of the above discussed guitar stand, such as that described in U.S. Pat. No. 3,765,633 to Caudill and U.S. Pat. No. 4,991,809 to Harkey, comprises a stand that is clamped to the amplifier by pressing two opposing flanges against the front and back surfaces of the amplifier. However, this clamping device tends to mar the amplifier to which it is attached. Moreover, the clamps could be awkward to handle and require set up and dismantling similar to those of free standing portable guitar stands.

Yet another known portable guitar stand, such as that described in U.S. Pat. No. 4,546,688 to Cuccio, comprises a neck cradle that is inserted into an amplifier jack socket and is supported by the jack socket. However, this stand cannot be used on other fixtures unless they had a similar jack socket. Moreover, the device cannot be used to hold an instrument when the amplifier jack socket is connected to a guitar cord. In addition, applying pressure to the jack socket on the amplifier could result in possible damage to the amplifier circuit or jack socket.

SUMMARY OF THE DISCLOSURE

It is an object of the present invention to provide an improved device for holding an object, and, in particular embodiments an improved device for holding a guitar which obviates for practical purposes, the above mentioned limitations.

According to an embodiment of the invention, a device for supporting an object, such as a guitar, against a fixture having a top surface, such as a table or amplifier, includes a slide resistant base. The base has a bottom surface adapted for placement on the top surface of the fixture and defines a holding means shaped to receive and hold, for example the neck of a guitar. The holding means, such as a neck cradle or bifurcated neck, is coupled to the base for holding the object stationary against the fixture. The slide resistant base is prevented from moving relative to the fixture by a restraining means on the bottom surface of the base. The restraining means uses surface contact with the top surface of the fixture for inhibiting movement of the base with respect to the fixture upon the base being placed on the top surface of the fixture, and when holding and supporting the object.

In an illustrative embodiment, the device has projections extending down from the base to resist the rearward force induced from resting the object against the device. The surfaces of the base and projections may be coated with non-skid materials to enhance the holding capabilities of the device and/or alternatively the base may be augmented with weights to resist sliding on the fixture. The device has a low profile and may be easily moved or stored, making it readily portable.

The device according to illustrated embodiments of the invention, has few or no multiple parts, thus making use and installation simple.

The illustrated embodiments of the invention may be fabricated out of a variety of materials, including but not limited to cardboard, wire, plywood, PLEXIGLASS ®, and plastic.

The illustrated embodiments of the present invention can be augmented with a separate pad, not physically connected to the device, placed between the object and a lower surface, e.g., a floor. This would allow protection of the object as it rests against the lower surface and would tend to keep the object from sliding on the lower surface.

Other features and advantages of the invention will become apparent from the following detailed description, taken in conjunction with the accompanying drawings, which illustrate, by way of example, various features of embodiments of the invention.

BRIEF DESCRIPTION OF THE DRAWING

The detailed description of embodiments of the invention will be made with reference to the accompanying drawings, wherein like numerals designate corresponding parts in the several figures.

DETAILED DESCRIPTION OF THE DISCLOSURE

Figure 1:
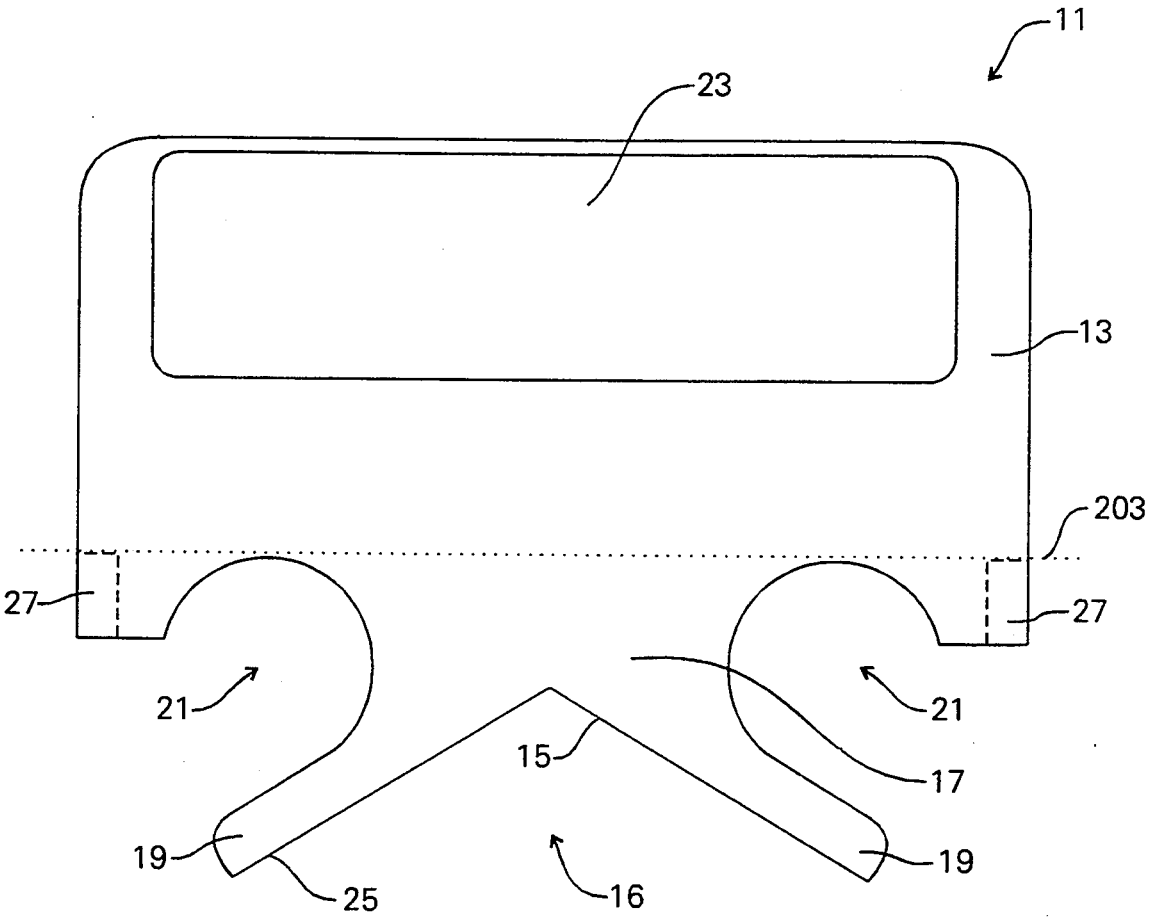
FIG. 1 is a top view of an embodiment of a portable guitar stand atop an amplifier.

As shown in the drawings for purposes of illustration, the invention is embodied in a portable guitar stand for supporting guitars. However, it will be recognized that further embodiments of the invention may be used to support various other objects, including but not limited to other musical instruments, pool cues, and rifles.

Figure 2:
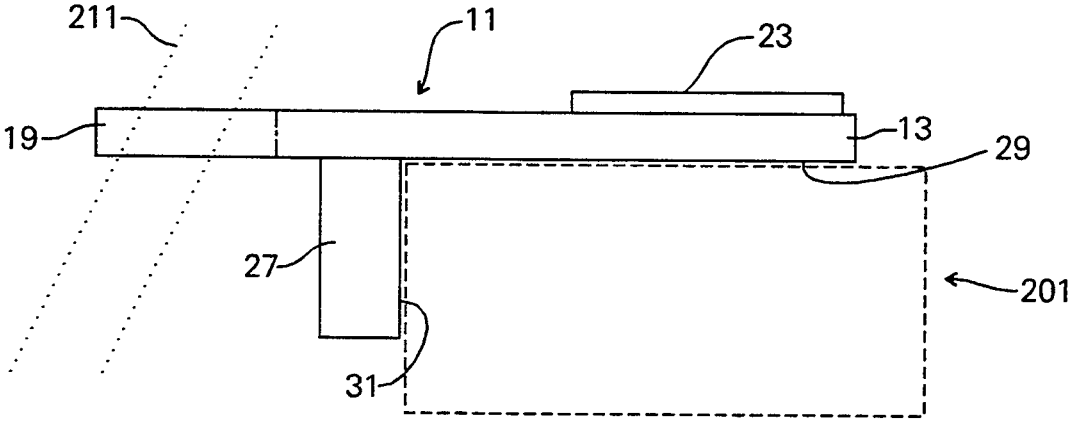
FIG. 2 is a side view of the embodiment of FIG. 1.

A first embodiment of a portable guitar stand 11 is indicated generally in FIGS. 1-2. The portable guitar stand 11 is preferably supported atop a table or an amplifier 201. It is appreciated, of course, that further embodiments of stand 11 may be used to support objects other than guitars, and may be used on fixtures other than a table or amplifier 201. This illustrated embodiment of the invention may be fabricated out of nearly any material; such as cardboard, wire, plywood, PLEXIGLASS ®, and plastic.

In the embodiment of the portable guitar stand 11 shown in FIGS. 1 and 2, a base 13 is designed to rest atop the amplifier 201 in a position such that it overhangs the amplifier edge 203, as shown in FIG. 1. On top of the base 13 is a weight 23, which can be affixed to the base by rivets, cement, or other suitable means to improve the frictional contact between the base 13 and the top of the amplifier 201. At the overhanging edge of the base 13, there extends a coupling portion 17 which couples a bifurcated neck 15 to the portion of the base 13 resting on the amplifier 201. The bifurcated neck 15 is made up of a pair of support members 19 which form a recess 16 in which a guitar neck 211 can be supported and held. FIG. 2 is a side view of the stand 11, showing the guitar neck 211 between the support members 19.

To prevent the portable guitar stand 11 from sliding back when the guitar neck 211 rests against it, a pair of motion restraining projections 27 extend down from the base 13 as illustrated by FIG. 2. These projections 27 engage the front of the amplifier 201 and serve to keep the stand 11 from sliding back along the top of the amplifier 201, such as when rearward force is applied by the guitar neck 211. When the projections 27 encounter the amplifier edge 203, they counter the rearward force and maintain the guitar in an upright secure position. The projections 27 also tend to keep the base 13 from tipping forward and off the amplifier 201. When the guitar neck 211 is in contact with bifurcated neck 15 of the stand 11, it exerts a downward force which can cause the base 13 to tip and pitch forward. The projections 27 bear against the side of the amplifier 201 and counter this rotational tipping force.

In FIGS. 1-2, both the rearward and tipping forces are additionally countered by a weight 23. The weight 23 acts to resist rearward movement by increasing the frictional contact between the base 13 and the amplifier 201 and, therefore, increasing the force needed to slide the base 13 with respect to the amplifier 201. The weight 23 also resists the tipping force from the guitar neck 211 by acting, with gravity, as a counter force. If the weight 23 is of sufficient magnitude, the projections 27 may be dispensed with. This would give the embodiment an even slimmer profile, allowing it to be more easily packed in a guitar case.

Another possible way to increase the frictional contact and, thus, the movement resistance is to apply a non-skid material to the portable guitar stand 11. For instance in FIG. 2, underneath the base 13 is a contact surface 29, and the bearing sides of the projections 27 have a contact surface 31. These can be layered or coated with non-skid materials to enhance the abilities of the stand 11 to remain in position. Also, the support members 19 of the bifurcated neck 15 have a contact surface 25 which may be provided with a layer or coating of smooth or threaded rubber, plastic, felt, or the like, to prevent movement and to prevent the guitar neck 211 from getting scratched or scarred from use of the stand 11.

It is also possible to further enhance the surface contact and movement resistance between the base 13 and the amplifier 201 by providing a layer of hook and loop fastening material, such as VELCRO ® on each of the surface 29 and the top surface of the amplifier 201. With the hook and loop material attaching the base 13 to the amplifier 201, the weight 23 or projections 27 may be omitted, but this would render the embodiments less portable, since additional hook and loop material would be needed for each fixture on which the embodiment is used.

Another way to improve the portable guitar stand 11 is to reduce the weight overhanging the amplifier edge 203. This can be done by forming knob notches 21, as shown in FIG. 1, in the coupling portion 17. This tends to reduce the tipping force, and tendency to tip forward, by moving the center of mass of the stand 11 further back from the amplifier edge 203 onto the top of the amplifier 201. These knob notches 21 can reduce or eliminate the need for the weight 23. In addition, the two knob notches 21 allow access to the knobs and controls beneath the overhanging portion of the stand 11. This allows the user to leave the stand 11 on the top surface of the fixture, without impeding the use of, the amplifier 201.

To use the portable guitar stand 11, shown in FIGS. 1-2, the user places the stand 11 atop a fixture, such as the amplifier 201. The stand is pushed back until the projections 27 contact the amplifier edge 203. The user may then rest the base of a guitar on the floor next to the amplifier 201 and lean the guitar neck 211 into the recess 16. A weight 23 on the stand 11 restrains the rearward and tipping motions when a guitar neck 211 rests against the recess 16. Although not shown, the security of the guitar can be further enhanced by adding a separate pad, not physically connected to the stand 11, of neoprene rubber or other suitable material, between the floor and the guitar.

The embodiment illustrated in FIGS. 1–2 is designed to be relatively simple and inexpensive to manufacture. It is designed to be easily placed or removed, and may be stored in the guitar case. Embodiments of the portable guitar stand can be provided in a variety of shapes and sizes, as shown by FIGS. 1–24.

Figure 3:
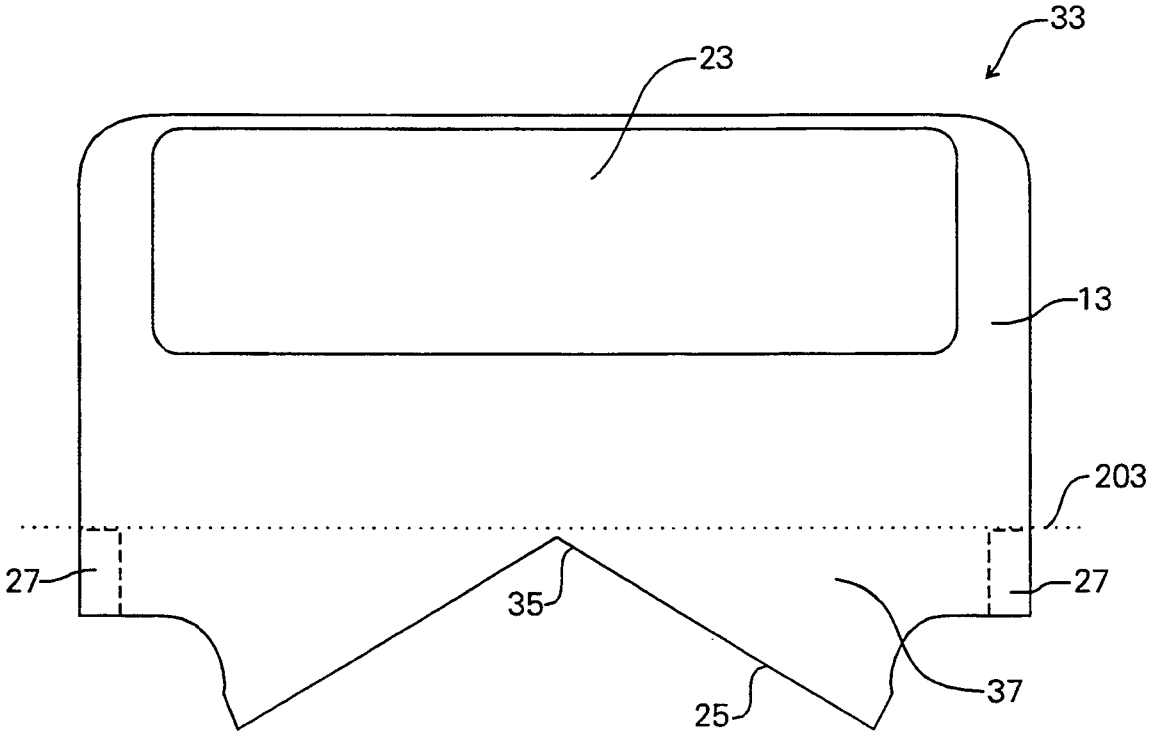
FIG. 3 is a top view of a variation of the embodiment of FIG. 1 atop an amplifier.

FIGS. 3 shows another portable guitar stand 33 as a variation of the embodiment of the present invention shown in FIGS. 1 and 2. This embodiment has a shorter coupling portion 37, a short extension of the base 13, which overhangs the amplifier edge 203. This shorter coupling portion 37, does not allow the same easy access to the knobs and buttons underneath the stand 33, like the embodiment described above. However, a smaller weight 23 can be used, because the bifurcated neck 35 does not hang over the amplifier edge 203 to the same extent. This reduces the tendency to tip and pitch over. The bifurcated neck 35 in this embodiment is a notch in the coupling portion 37 of the base 13. This embodiment tends to support the guitar neck 211 far closer to the amplifier edge 203, than the embodiment shown in FIG. 2. The projections 27 can be smaller since they have to resist less tipping force. This results in an embodiment that is lighter and smaller than the embodiment described above and shown in FIGS. 1–2.

Figure 4:
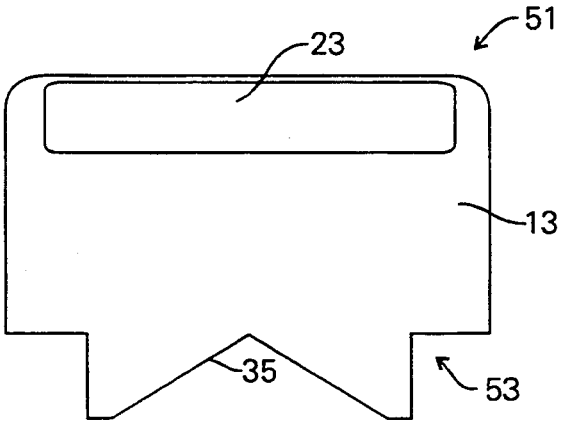
FIGS. 4–11 are top views of other embodiments of the present invention.

FIGS. 4 to 11 show several top views of other embodiments of the present invention. FIG. 4 shows a portable guitar stand 51 with a rectilinear design. This stand 51 uses a long, thin weight 23 mounted towards the back of the base 13. The stand 51 has rectangular notches 53. The bifurcated neck 35 extends out directly from the portion of the base 13 which rests on the top surface of the amplifier 201, in a manner similar to the embodiment of FIG. 3.

Figure 5:
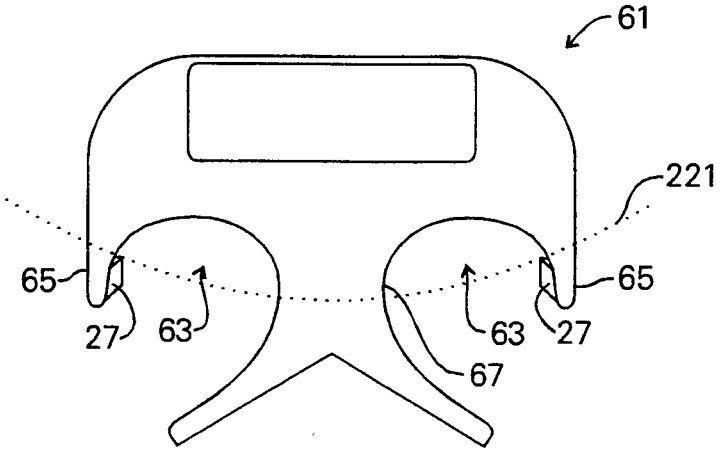

FIG. 5 shows a portable guitar stand 61, which is designed to more readily work with a circular table edge 221. The stand 61 has extended projection legs 65 for holding the projections 27, this allows the bulk of the stand's mass to rest on the table top. The knob notches 63 are deeper to further reduce mass extending over the circular table edge 221.

Figure 6:
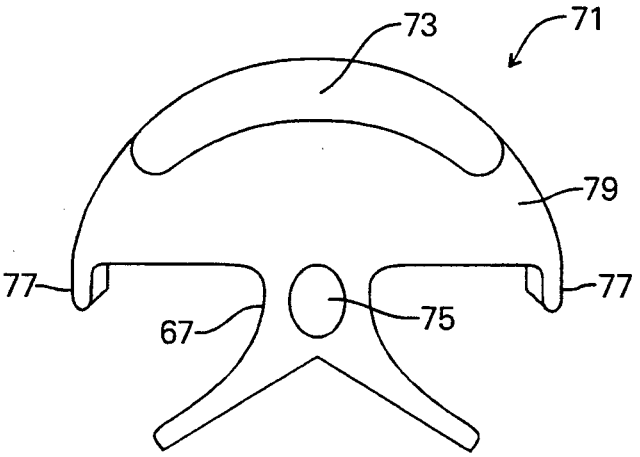

FIG. 6 shows another portable guitar stand 71 having a curved weight 73 along the curved rear edge of the base 79. This tends to pull the center of mass back further onto the circular table top. This embodiment has extended projections legs 77 similar to those shown in FIG. 5. The bifurcated neck 67 has a weight reducing hole 75, allowing the bifurcated neck 67 to extend further from the table edge, while reducing the chance of tipping due to a heavy overhanging portion.

Figure 7:
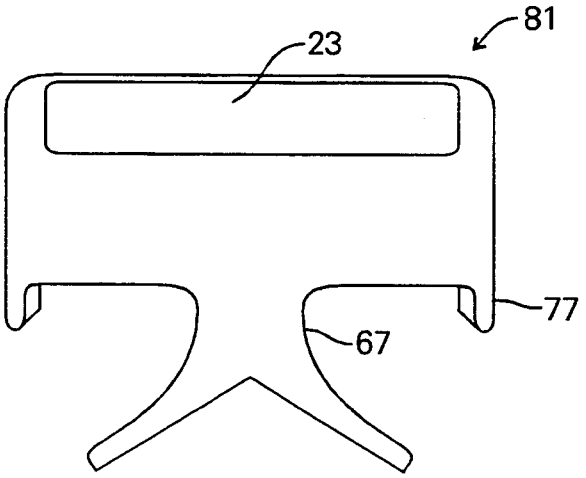

FIG. 7 shows a portable guitar stand 81, which is similar to FIG. 6, except it has a rectangular back and a long, thin rectangular weight 23.

Figure 8:
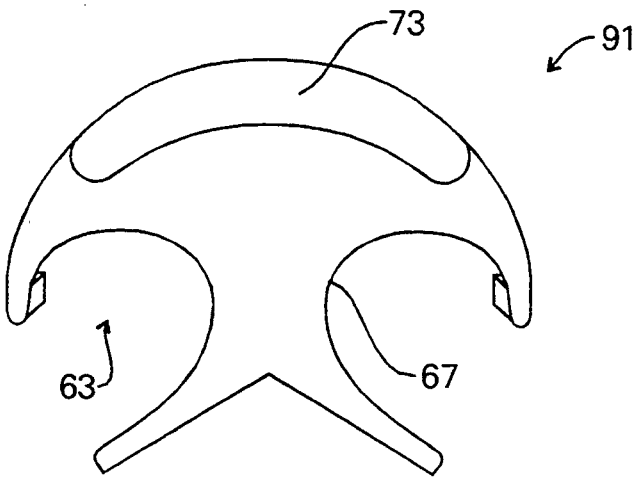

FIG. 8 shows a portable guitar stand 91 which combines FIGS. 5 and 6. The stand 91 has the accentuated knob notches of FIG. 5, and both the curved back and weight of FIG. 6.

Figure 9:
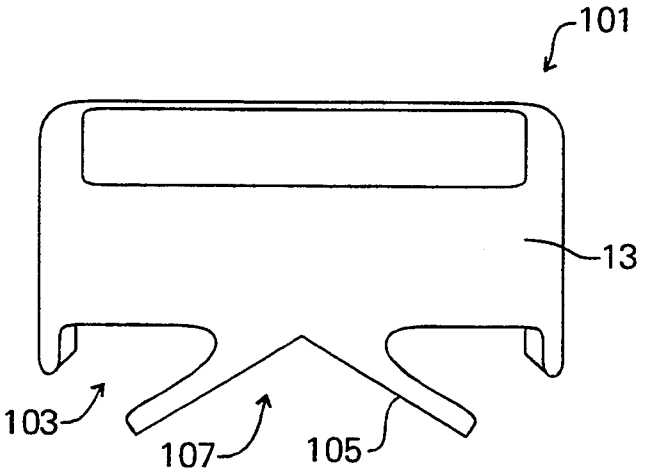

FIG. 9 shows a portable guitar stand 101 which is similar to FIG. 7, but this embodiment has a shorter coupling portion. In this embodiment the bifurcated neck extends directly from the portion of the base 13 which rests on the top surface of the amplifier 201. This provides a shorter distance from the edge of the base 13 to the bifurcated neck 105 supporting of the guitar neck 211 in the recess 107. This reduces the tendency of the stand 101 to tip.

Figure 10:
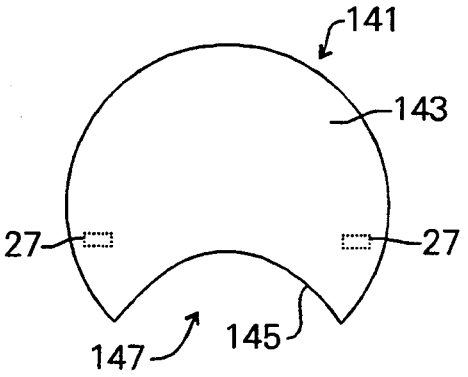
Figure 11:
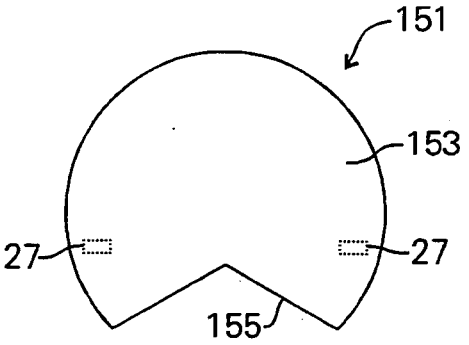

FIGS. 10 and 11 are embodiments using a circular base, for ease of manufacture. This embodiment may be provided with motion restraining projections 27 as indicated in the figures.

FIG. 10 shows a portable guitar stand 141 comprised of a circular base 143, and projections 27 attached underneath the circular base 143. Instead of a bifurcated neck, stand 141 uses a curved notch 145 which provides a recess 147 for supporting the guitar neck 211.

FIG. 11 shows another embodiment of a circular portable guitar stand 151 having a circular base 153 and projections 27 attached underneath the circular base 153. Instead of a curved notch, as shown in FIG. 10, this embodiment has a V-shaped notch 155 to support the guitar neck 211.

Figure 12A:
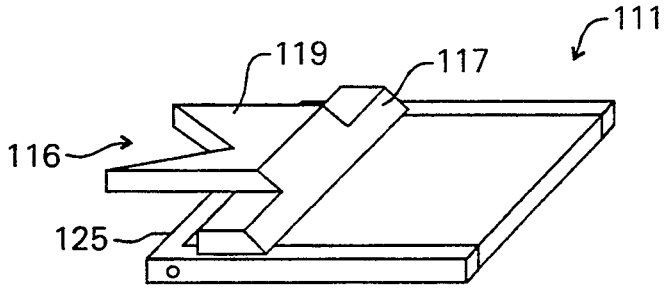
FIGS. 12(*a*)–(*b*) are perspective views of an embodiment of the present invention having folding legs.
Figure 12B:
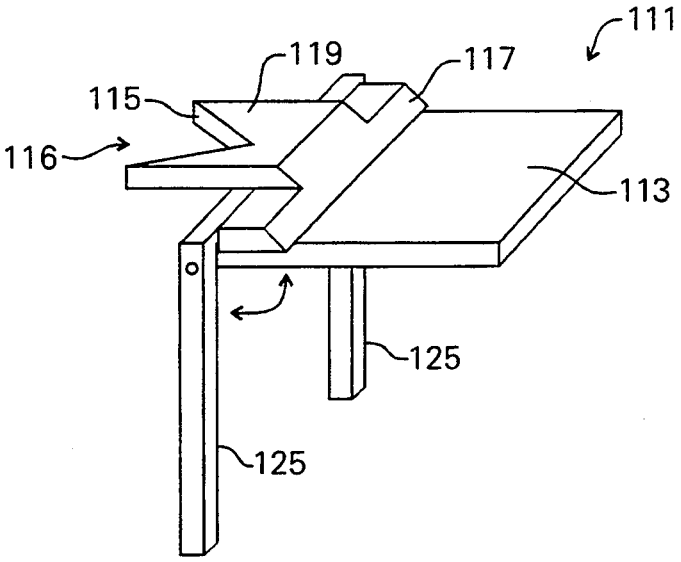
Figure 13:
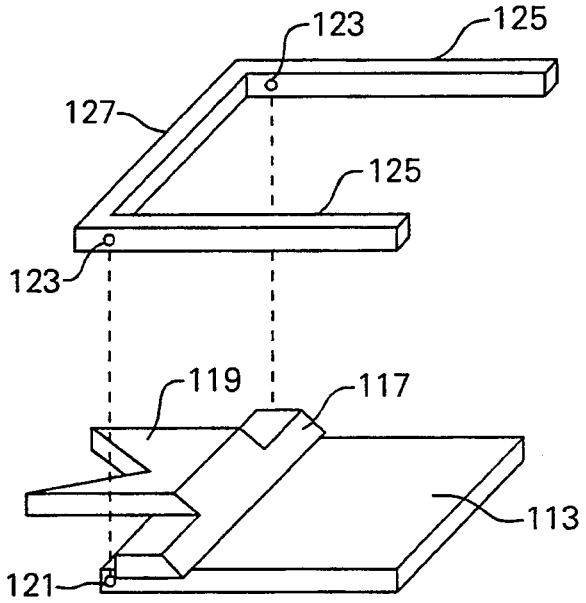
FIG. 13 is an exploded perspective view of the embodiment of FIGS. 12(*a*)-(*b*).

FIGS. 12 and 13 show a portable guitar stand 111 as an embodiment of the present invention having folding motion restraining projections 125. The stand 111 folds to provide a flatter profile for easy storage, such as in a guitar case. As shown in the exploded perspective view of FIG. 13, a coupling portion 117 is coupled to the top of the base 113, in a manner different from the simple extensions of the previously described embodiments. The coupling portion 117 overhangs the sides of the base 113 to prevent the projections 125 from passing above the top of the base 113. Coupled to the top of the coupling portion 117 is a bifurcated neck 115 for holding a guitar neck 211. The bifurcated neck 115 is formed by a pair of support members 119 which form a recess 116.

FIG. 13 also shows a pair of projections 125 connected together by a connecting member 127. The projections 125 fit along the sides of the base 113 and are connected to the base 113 by a pivot means 121, such as a pin, bearing, or the like, attached to the base 113 through a pivot hole 123 on the projections 125. The projections 125 can rotate 90° to an extended position from the folded position, as shown in FIG. 12(*a*) (the folded position), and FIG. 12(*b*) (the extended position). Once the projections 125 are extended the stand 111 can be placed atop a table or an amplifier 201 and used to support a guitar.

The projections 125 will not pivot beyond 90°, because the connecting member 127 is restrained by the top mounted coupling portion 117 when the projections 125 are unfolded from the base 113. The connecting member 127 fits underneath the bifurcated neck 115 and does not impede support of the guitar. This stand 111 is shown without a weight, however, it could be provided with a weight for additional stability.

Figure 14A:
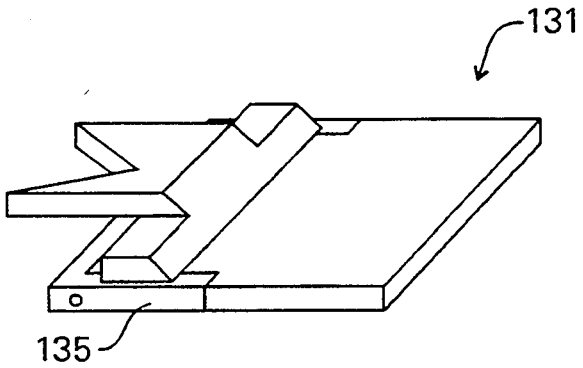
FIGS. 14(*a*)-(*b*) are a perspective views of another embodiment of the present invention having folding legs.
Figure 14B:
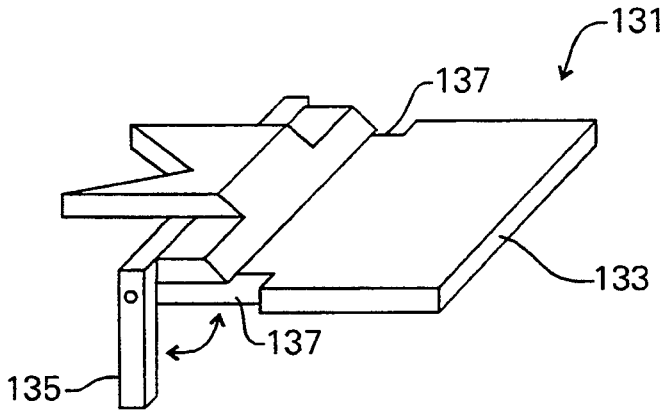

FIGS. 14(*a*)–(*b*) show another embodiment of a portable guitar stand 131 similar to the embodiment in FIGS. 12 and 13. The stand 131 has a base 133 with two recessed notches 137, to accept shorter projections 135. The projections 135 are dimensioned to fit into the notches 137 when in the folded state.

Figure 15:
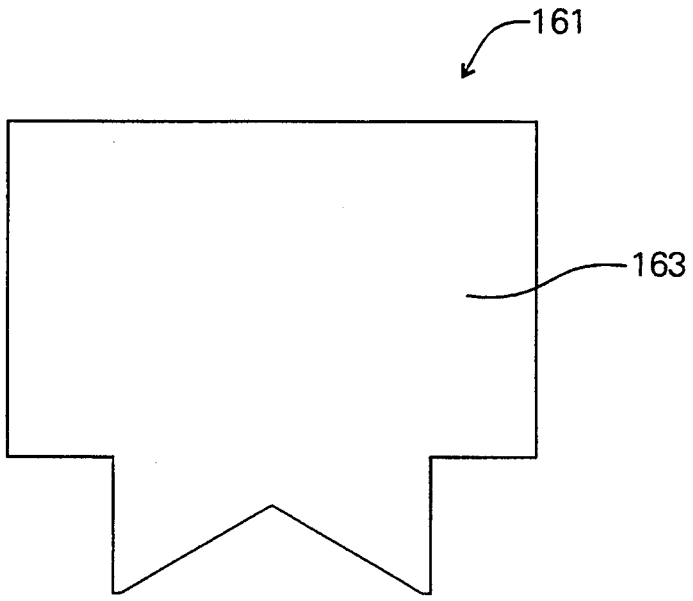
FIGS. 15 is a top view of a further embodiment of the present invention.
Figure 16:
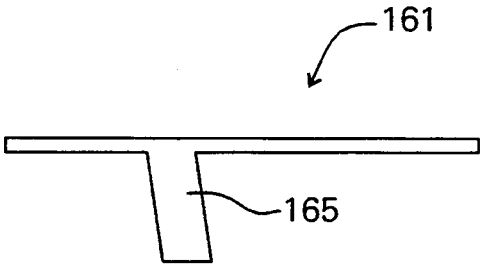
FIG. 16 is a side view of the embodiment shown in FIG. 15.

FIGS. 15 and 16 show another embodiment of the present invention, wherein a portable guitar stand 161 is made from a single unitary structure 163. The structure 163 is provided with a pair of restraining projections 165 and a bifurcated neck for support of the guitar neck 211. This structure 163 may be formed from a sheet of material, wherein the projections 165 are formed by folding portions of the sheet down. This embodiment shows that the projections 165 may be angled toward the back of the structure, as opposed to being 90°. The stand 161 is shown without a weight, however, one could be added for further stability. The stand 161 could also be augmented with non-skid materials as discussed above.

Figure 17:
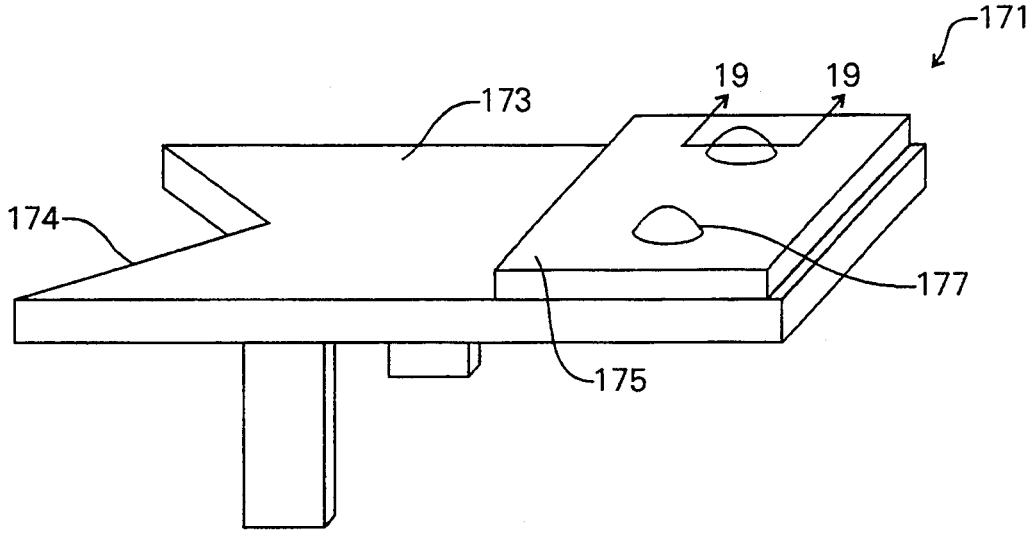
FIGS. 17 is a perspective view of an embodiment of the present invention for mounting a weight on a base.

The weight 23 shown in the previously described embodiments may be attached to the base by any suitable means, including adhesive materials. FIGS. 17–21 show alternative methods for coupling a weight 175 to a base of the various embodiments. FIG. 17 shows a completely assembled portable guitar stand 171 having a base 173, a bifurcated neck 174 and a weight 175 attached by locking members 177. In the exploded view of FIG. 18, the weight 175 is shown as having locking member receiving holes 179 for receiving the locking members 177. The base 173 has locking member receivers 181 for coupling with the locking members 177.

Figure 18:
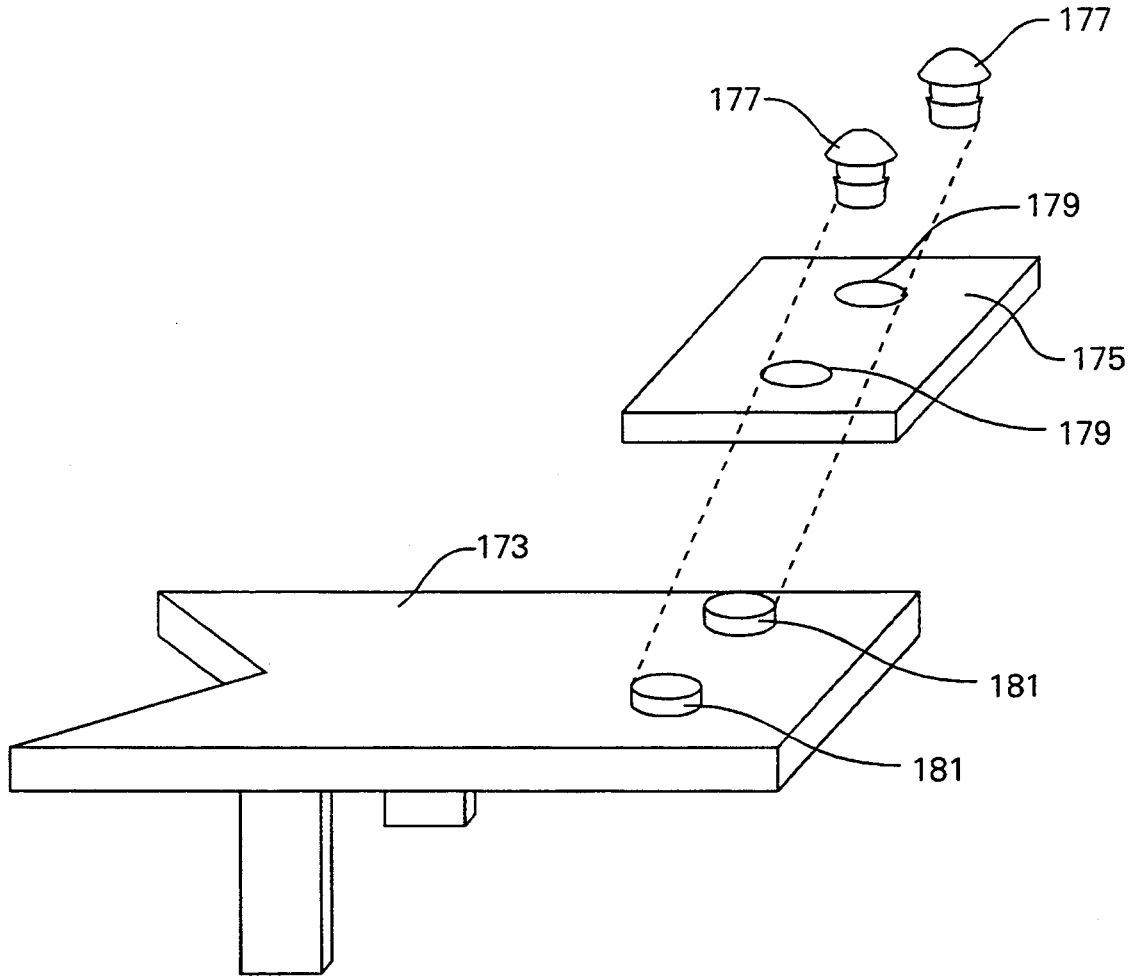
FIG. 18 is an exploded perspective view of the embodiment shown in FIG. 17.
Figure 19A:
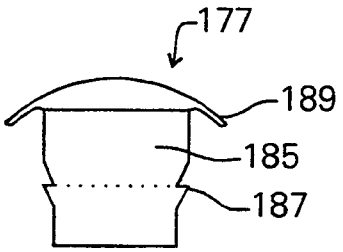
FIGS. 19(*a*)-(*e*) are cross-sectional side views of the mounting system along the line 19—19 in FIG. 17.
Figure 19B:
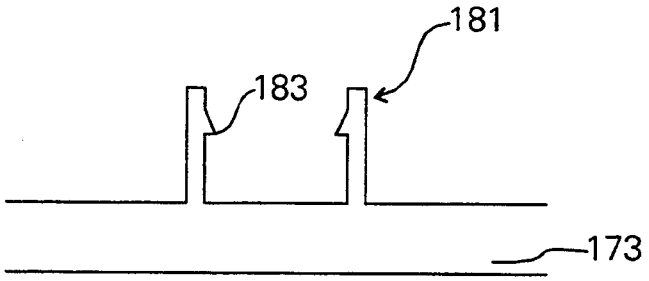
Figure 19C:
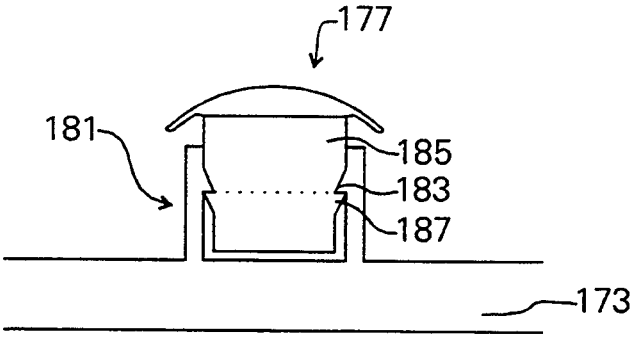
Figure 19D:
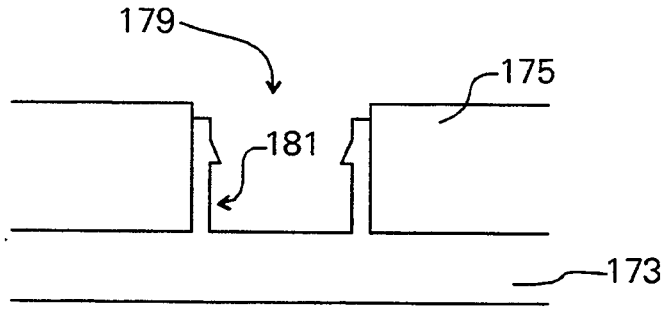
Figure 19E:
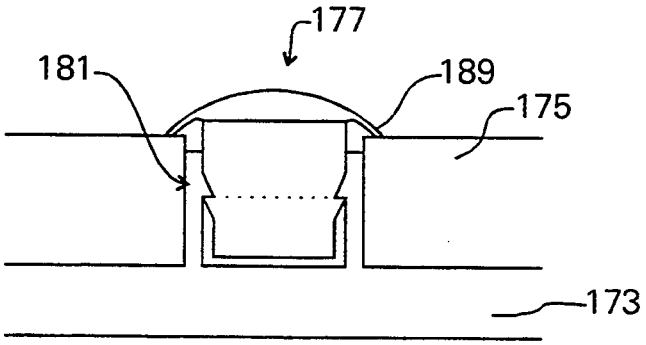

FIG. 19 is a cross-sectional view, along the line 19—19 in FIG. 17, illustrating how the weight 175 is coupled to the base 173 using the locking members 177 shown in FIGS. 17 and 18. FIG. 19(*a*) shows a locking member 177 having a shaft 185 with a restraining lip 187. The top of the locking member 177 has a restraining flange 189.

FIG. 19(*b*) shows the locking member receiver 181 having a locking lip 183. The locking member receiver 181 is shown formed as part of the base 173.

FIG. 19(*c*) shows how the restraining lip 187 on the shaft 185 of the locking member 177 couples with the locking lip 183 of the locking member receiver 181.

FIG. 19(*d*) shows how the weight 175 slides over the locking member receivers 181 with the receivers 181 extending through the receiving holes 179.

FIG. 19(*e*) shows the weight coupling system when it is used to couple the weight 175 with the base 173. This shows that the restraining flange 189 of the locking member 177 also presses on the weight 175 to hold it against the base 173.

Figure 20:
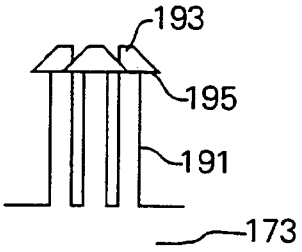
FIG. 20 is a side view of an alternative weight mounting system.
Figure 21:
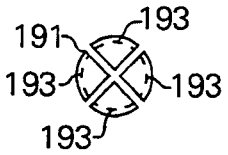
FIG. 21 is a top view of the weight mounting system shown in FIG. 20.

FIGS. 20 and 21 shows another alternative to the system illustrated in FIG. 19. Instead of two parts forming the weight coupling system, the base 173 has restraining members 191 extending from the base 173. The restraining members 191 terminate with a restraining head 193 having a locking lip 195. As shown in FIG. 21, there are four restraining members 191. When the weight 175 is placed over the base 173, the restraining members 191 are pushed together. This allows the weight 175 to pass over the restraining heads 193 and locking lips 195. Then the weight 175 is seated, the restraining members 191 decompress and straighten, such that the weight 175 is held against the base 173 by the restraining heads 193 and locking lips 195.

Figure 22:
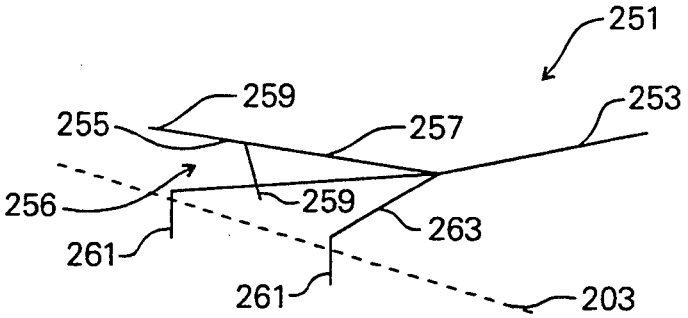
FIG. 22 is a perspective view of yet another embodiment of the present invention.
Figure 23:
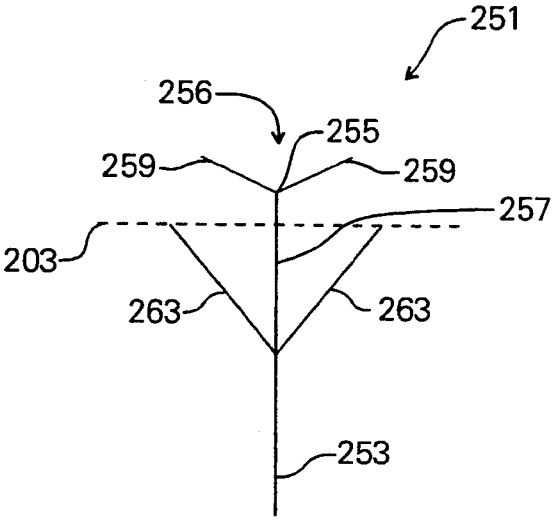
FIG. 23 is a top view of the embodiment shown in FIG. 22.
Figure 24:
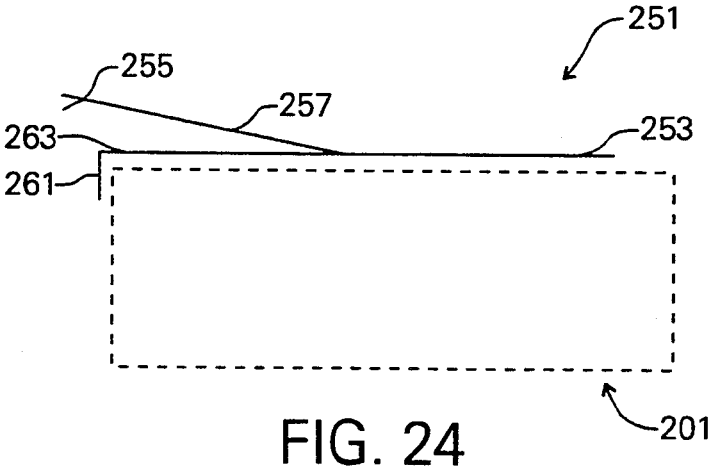
FIG. 24 is a side view of the embodiment shown in FIG. 22.

FIGS. 22–24 illustrate another embodiment of the present invention, where the portable guitar stand 251 is made of wire, adjustable metal bars, or the like. The stand 251 has a base 253 which connects to a bifurcated neck 255 by a coupling portion 257. The bifurcated neck 255 is formed by a pair of neck members 259 forming a recess 256. The coupling portion 257 may be pivotally coupled to the base 253, such that the bifurcated neck 255 can be orientated to various heights and angles. However, this pivotal coupling is not necessary if the potable guitar stand 251 is made from a semi-flexible wire.

Coupled to the base 253 is a pair of horizontal supports 263 for holding the motion restraining projections 261. The stand 251 works similarly to the embodiments describe above, and can be augmented with further improvements in many of the same ways as discussed above with regard to other embodiments. The stand 251 provides a small, lightweight easily adaptable embodiment which is extremely portable and easy to manufacture.

It will be recognized that certain features shown and described for each embodiment in FIGS. 1–24 may be interchanged or added to the various other embodiments shown in the figures. It will also be recognized that the above embodiments shown for use on particular fixtures, such as rectangular amplifiers or the like, may be used with other fixtures, such as circular tables or the like.

Though not illustrated, it is possible to attach the above described embodiments of the present invention to the top of an amplifier 201 via a bracket which remains on the amplifier. This measure would eliminate any need for weighting, but would limit versatility and render the embodiments no longer truly portable.

The embodiments may be used to hold other objects, such as other musical instruments, rifles and pool cues. For instance, it could be used as a portable pool cue rack. The rack would be placed on a pool table to provide a stable place against which a cue may be leaned without fear of it sliding to one side and falling.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for supporting an object against a fixture having a top surface, comprising:

a base having a bottom surface adapted for placement on the top surface of the fixture;

holding means coupled to the base for holding the object stationary against the fixture; and restraining means on the bottom surface of the base using surface contact with the top surface of the fixture for inhibiting movement of the base with respect to the fixture when holding and supporting the object;

wherein a weight is coupled to the base, such that the movement is further inhibited.

2. A device according to claim 1, wherein the restraining means further comprises projections extending down from the base and positioned to bear against an edge of the fixture upon placement of the base on the top surface of the fixture.

3. A device for supporting an object against a fixture having a top surface, comprising:

a base having a bottom surface adapted for placement on the top surface of the fixture;

holding means coupled to the base for holding the object stationary against the fixture; and restraining means on the bottom surface of the base using surface contact with the top surface of the fixture for inhibiting movement of the base with respect to the fixture when holding and supporting the object;

wherein the restraining means comprises projections extending down from the base and positioned to bear against an edge of the fixture upon placement of the base on the top surface of the fixture.

4. A device according to claim 3, wherein the projections have surfaces adapted to contact the fixture upon the base being place on the top surface of the fixture, the projection surfaces being coated with a non-skid material.

5. A device according to claim 3, wherein the projections extending down from the base are foldable.

6. A device for supporting an object against a fixture having a top surface, comprising:

a base having a bottom surface adapted for placement on the top surface of the fixture;

holding means coupled to the base for holding the object stationary against the fixture; and restraining means on the bottom surface of the base using surface contact with the top surface of the fixture for inhibiting movement of the base with respect to the fixture when holding and supporting the object;

wherein the base has notches to allow access to the fixture upon the base being placed on the top surface of the fixture.

7. A device for supporting an object against a fixture having a top surface, comprising:

a base having a bottom surface adapted for placement on the top surface of the fixture;

holding means coupled to the base for holding the object stationary against the fixture; and restraining means on the bottom surface on the base using surface contact with the top surface of the fixture for inhibiting movement of the base with respect to the fixture when holding and supporting the object;

wherein the holding means has notches to allow access to the fixture upon the base being placed on the top surface of the fixture.

8. A device fixture according to claim 7, wherein the holding means comprises a bifurcated neck for cradling the object.

9. A device for supporting an object against a fixture having a top surface, comprising:

a base having a bottom surface adapted for placement on the top surface of the fixture;

holding means coupled to the base for holding the object stationary against the fixture; and restraining means on the bottom surface of the base using surface contact with the top surface of the fixture for inhibiting movement of the base with respect to the fixture when holding and wherein there is a lower surface adjacent to the fixture, wherein the device further comprises a pad adapted to be placed between the object and a lower surface so as to cushion and prevent slipping of the object against the lower surface.

10. A device for supporting an object against a fixture having a top surface, comprising:

a base having a bottom surface adapted for placement on the top surface of the fixture;

holding means coupled to the base for holding the object stationary against the fixture; and restraining means on the bottom surface of the base using surface contact with the top surface of the fixture for inhibiting movement of the base with respect to the fixture when holding and supporting the object;

wherein the base, holding means and restraining means are made from wire.

11. A method of supporting an object against a lower surface and a fixture having a top surface, comprising the steps of:

providing a base having a bottom surface;

placing the bottom surface of the base on the top of the fixture;

leaning the object against the base;

restraining movement of the base with respect to the fixture using surface contact between the bottom surface of the base and the top surface of the fixture; and coupling a weight to the base to restrain movement of the base relative to the fixture.

12. A method according to claim 11, further comprising the step of extending projections down from the base to bear against a side of the fixture to further restrain movement of the base relative to the fixture.

13. A portable guitar stand for holding a guitar with a neck against a fixture having a top surface and a side, comprising:

a base having a top and a bottom surface, wherein the bottom surface is adapted for placement on the top surface of the fixture;

a neck support for holding the neck of the guitar;

a coupling portion for connecting the neck support to the base; and projections extending down from the bottom surface of the base and arranged to bear against the side of the fixture, such that movement of the base relative to the fixture is restrained upon the bottom surface of the base contacting the top surface of the fixture.

14. A portable guitar stand according to claim 13, wherein the projections are foldable.

15. A portable guitar stand according to claim 13, wherein the projections have a bearing surface, and wherein the bottom surface of the base and the bearing surface of the projections are coated with non-skid material.

16. A portable guitar stand according to claim 13, further comprising a weight attached to the top surface of the base.

17. A portable guitar stand according to claim 13, wherein hook and loop fasteners are attached to the bottom surface of the base and the top surface of the fixture, and further restrain movement of the base relative to the fixture upon placement of the base on the top surface of the fixture.

18. A portable guitar stand according to claim 13, wherein the coupling portion has notches to allow access to the fixture upon the base being placed on the top surface of the fixture.

19. A portable guitar stand according to claim 13, wherein the neck support is bifurcated and formed by a pair of forked members.

20. A portable guitar stand according to claim 13, further comprising a pad adapted to be placed between the guitar and a lower surface so as to cushion and prevent slipping of the guitar against the lower surface.

21. A portable guitar stand according to claim 13, wherein the base, neck support, coupling portion and projections are made from wire.

* * * * *